US011859481B2

(12) United States Patent
Fu et al.

(10) Patent No.: US 11,859,481 B2
(45) Date of Patent: Jan. 2, 2024

(54) FRACTURING APPARATUS

(71) Applicant: YANTAI JEREH PETROLEUM EQUIPMENT & TECHNOLOGIES CO., LTD., Shandong (CN)

(72) Inventors: Shanwu Fu, Shandong (CN); Ruijie Du, Shandong (CN); Jian Zhang, Shandong (CN); Jifeng Zhong, Shandong (CN); Sheng Chang, Shandong (CN); Xiaolei Ji, Shandong (CN)

(73) Assignee: YANTAI JEREH PETROLEUM EQUIPMENT & TECHNOLOGIES CO., LTD., Shandong (CN)

( * ) Notice: Subject to any disclaimer, the term of this patent is extended or adjusted under 35 U.S.C. 154(b) by 0 days.

(21) Appl. No.: 17/698,644

(22) Filed: Mar. 18, 2022

(65) Prior Publication Data

US 2023/0120810 A1 Apr. 20, 2023

(30) Foreign Application Priority Data

Oct. 14, 2021 (CN) ..... 202111198126.0
Oct. 14, 2021 (CN) ..... 202122477998.2

(51) Int. Cl.
*E21B 43/26* (2006.01)
*F04B 53/16* (2006.01)
(Continued)

(52) U.S. Cl.
CPC ..... *E21B 43/2607* (2020.05); *F04B 53/002* (2013.01); *F04B 53/08* (2013.01);
(Continued)

(58) Field of Classification Search
CPC .... E21B 43/2607; F04B 53/002; F04B 53/08; F04B 53/16; F04B 15/02; F04B 47/02; F04B 49/06; F04B 53/18
See application file for complete search history.

(56) References Cited

U.S. PATENT DOCUMENTS 10,741,158 B1 * 8/2020 Aune ..... G10K 11/162
11,460,018 B2 * 10/2022 Brunson, Jr. ..... F04B 39/0033
(Continued)

FOREIGN PATENT DOCUMENTS

CN 204532531 U 8/2015
CN 105508044 A 4/2016
(Continued)

OTHER PUBLICATIONS

CN214330604 translation (Year: 2023).*
Written Opinion and International Search Report for PCT Application No. PCT/CN2022/073164 dated Jun. 1, 2022.

*Primary Examiner* — Kenneth J Hansen
*Assistant Examiner* — David N Brandt

(57) ABSTRACT

A fracturing apparatus is provided. The fracturing apparatus includes a plunger pump, a transmission shaft, a main motor, an oil pipe, a first radiator and a noise reduction cabin. The main motor is spaced apart from the plunger pump, the plunger pump is connected with the main motor through the transmission shaft; the oil pipe is configured to be connected with the plunger pump; the first radiator is spaced apart from the plunger pump, the first radiator is configured to dissipate heat from oil in the oil pipe, the main motor, the first radiator and at least part of the oil pipe are all located inside the noise reduction cabin, and the plunger pump is located outside the noise reduction cabin.

20 Claims, 5 Drawing Sheets

(51) Int. Cl.

| | |
|---|---|
| ***F04B 53/00*** | (2006.01) |
| ***F04B 53/08*** | (2006.01) |
| ***F04B 15/02*** | (2006.01) |
| ***F04B 47/02*** | (2006.01) |
| ***F04B 49/06*** | (2006.01) |
| ***F04B 53/18*** | (2006.01) |

(52) U.S. Cl.
CPC ..... *F04B 53/16* (2013.01); *F04B 15/02* (2013.01); *F04B 47/02* (2013.01); *F04B 49/06* (2013.01); *F04B 53/18* (2013.01)

(56) References Cited

U.S. PATENT DOCUMENTS

| | | | | |
|---|---|---|---|---|
| 2016/0258267 | A1* | 9/2016 | Payne | E21B 43/26 |
| 2018/0298731 | A1* | 10/2018 | Bishop | E21B 7/022 |
| 2018/0328157 | A1* | 11/2018 | Bishop | F04B 17/06 |
| 2019/0154020 | A1* | 5/2019 | Glass | F04B 15/02 |

FOREIGN PATENT DOCUMENTS

| | | | | | |
|---|---|---|---|---|---|
| CN | 210105985 | U | | 2/2020 | |
| CN | 211500798 | U | | 9/2020 | |
| CN | 113006758 | A | | 6/2021 | |
| CN | 214247597 | U | | 9/2021 | |
| CN | 214330604 | | * | 10/2021 | E21B 43/26 |
| CN | 214330604 | U | | 10/2021 | |
| CN | 113819030 | A | | 12/2021 | |

* cited by examiner

FRACTURING APPARATUS

FRACTURING APPARATUS

The present application claims priority of the Chinese Patent Application No. 202111198126.0, filed on Oct. 14, 2021, the content of which is incorporated in its entirety as portion of the present application by reference herein. The present application also claims priority of the Chinese Patent Application No. 202122477998.2, filed on Oct. 14, 2021, the content of which is incorporated in its entirety as portion of the present application by reference herein.

TECHNICAL FIELD

The embodiments of the present disclosure relate to a fracturing apparatus.

BACKGROUND

In the oil and gas field fracturing operation site, the noise value of high-power devices is high. In the case where the engine is in rated working condition, when the noise is tested at a horizontal distance of lm from the engine and a height of 1.5 m~1.7 m from the ground, the noise level requirement is that the noise level of the engine with installed power greater than or equal to 900 kW is not greater than 115 dB (A). Therefore, high-power electric drive fracturing apparatus needs to meet high noise reduction requirements.

SUMMARY

Embodiments of the present disclosure provides a fracturing apparatus. The fracturing apparatus includes: a plunger pump, a transmission shaft, a main motor, an oil pipe and a first radiator. The main motor is spaced apart from the plunger pump, the plunger pump is connected with the main motor through the transmission shaft; the oil pipe is configured to be connected with the plunger pump; and the first radiator is spaced apart from the plunger pump, and is configured to dissipate heat from oil in the oil pipe. The fracturing apparatus further includes a noise reduction cabin, the main motor, the first radiator and at least part of the oil pipe are all located inside the noise reduction cabin, and the plunger pump is located outside the noise reduction cabin.

For example, according to embodiments of the present disclosure, the fracturing apparatus further includes a platform, wherein the plunger pump, the main motor and the noise reduction cabin are all located on a supporting surface of the platform, the noise reduction cabin includes an air inlet and an air outlet, and a distance between the air outlet and the supporting surface is greater than a distance between the air inlet and the supporting surface.

For example, according to embodiments of the present disclosure, the noise reduction cabin includes a cabin top wall, a cabin side wall and a cabin door, the cabin top wall is closer to the first radiator than the platform, and the first radiator is located at a side of the main motor away from the plunger pump.

For example, according to embodiments of the present disclosure, the cabin top wall is provided with the air outlet, the first radiator includes a heat dissipation pipe and a fan, the heat dissipation pipe is located between the fan and the air outlet, and the fan is configured to blow air to the heat dissipation pipe to dissipate heat.

For example, according to embodiments of the present disclosure, a second radiator is provided at a side of the main motor away from the platform, and the second radiator is configured to dissipate heat from the main motor; the noise reduction cabin is provided with a noise reduction structure, the noise reduction structure is configured to reduce noise of the second radiator, and at least part of the noise reduction structure is located at a side of the second radiator away from the platform.

For example, according to embodiments of the present disclosure, the cabin top wall is closer to the second radiator than the platform.

For example, according to embodiments of the present disclosure, the noise reduction structure is arranged on at least one of the cabin top wall and the cabin side wall.

For example, according to embodiments of the present disclosure, the noise reduction structure includes a labyrinth noise reduction portion, and the labyrinth noise reduction portion includes a plurality of baffle plates.

For example, according to embodiments of the present disclosure, the noise reduction structure further includes a noise reduction cavity, the labyrinth noise reduction portion is arranged at an opening of the noise reduction cavity facing the main motor, and an exhaust outlet is provided at a side of the noise reduction cavity away from the main motor.

For example, according to embodiments of the present disclosure, the noise reduction structure is arranged on the cabin side wall, the noise reduction cavity protrudes to a side away from the main motor with respect to the cabin side wall, and the noise reduction structure is located between the main motor and the plunger pump.

For example, according to embodiments of the present disclosure, a first sound-absorbing layer is provided at an inner wall of the noise reduction cavity; and/or, a second sound-absorbing layer is provided at a side, facing an interior of the noise reduction cabin, of at least one selected from the group consisting of the cabin top wall, the cabin side wall and the cabin door.

For example, according to embodiments of the present disclosure, a distance between one end of the exhaust outlet close to the labyrinth noise reduction portion and the supporting surface of the platform is greater than a distance between one end of the exhaust outlet away from the labyrinth noise reduction portion and the supporting surface, so that the exhaust outlet exhausts obliquely upward away from the platform.

For example, according to embodiments of the present disclosure, the plurality of baffle plates are arranged in a direction perpendicular to the supporting surface of the platform, each of the plurality of baffle plates includes at least two sub-portions connected in sequence to form a bending portion, and a gap is provided between adjacent baffle plates.

For example, according to embodiments of the present disclosure, at least one of the cabin side wall and the cabin door is provided with the air inlet.

For example, according to embodiments of the present disclosure, the fracturing apparatus further includes: an electric control cabinet, located in the noise reduction cabin; and a lubricating motor, located in the noise reduction cabin. The electric control cabinet includes a frequency converter, the main motor is located between the electric control cabinet and the plunger pump, and the main motor is located between the lubricating motor and the plunger pump.

For example, according to embodiments of the present disclosure, the electric control cabinet is located between the first radiator and the platform, and an orthographic projection of the electric control cabinet on the supporting surface overlaps with an orthographic projection of the first radiator on the supporting surface.

For example, according to embodiments of the present disclosure, the lubricating motor is located between the first radiator and the platform, and an orthographic projection of the lubricating motor on the supporting surface overlaps with an orthographic projection of the first radiator on the supporting surface.

For example, according to embodiments of the present disclosure, the cabin door includes a first cabin door and a second cabin door, the first cabin door is configured to expose the electric control cabinet upon being opened, and the second cabin door is configured to expose the lubricating motor upon being opened; in a case where the cabin door is closed, the second cabin door overlaps with the first cabin door, and an overlapping part of the second cabin door is located at an outer side of an overlapping part of the first cabin door.

For example, according to embodiments of the present disclosure, the exhaust outlet is provided with a cover plate, and a flow guide groove is provided at a side of the noise reduction cavity close to the platform.

For example, according to embodiments of the present disclosure, a hook is provided at a surface of the noise reduction cavity away from the main motor, and the hook overlaps with the transmission shaft in a direction perpendicular to the supporting surface of the platform.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

Figure 1:
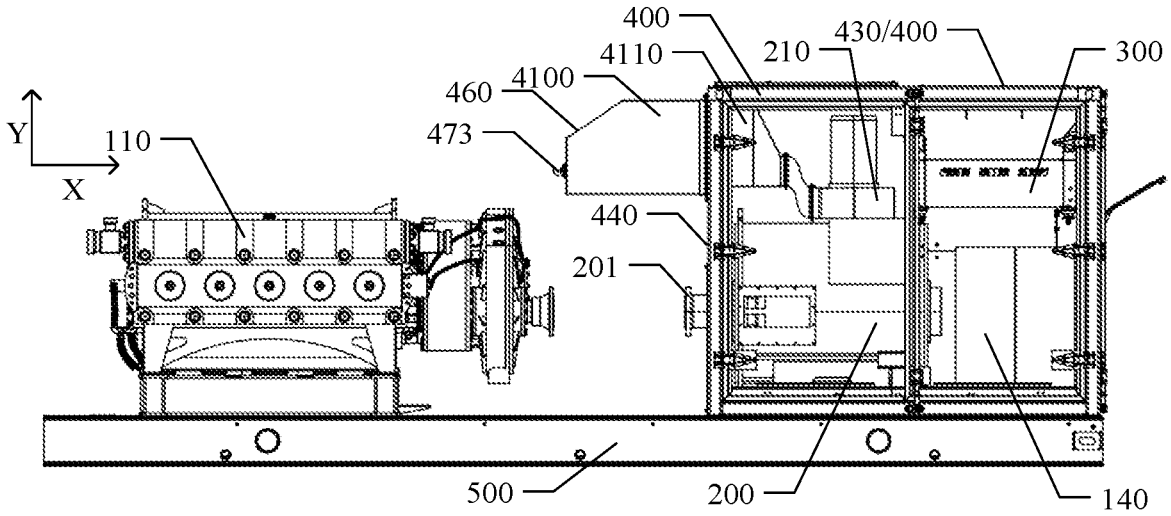
FIG. 1 is a side view of a partial structure of a fracturing apparatus according to an embodiment of the present disclosure.

In order to make objects, technical solutions, and advantages of the embodiments of the present disclosure apparent, the technical solutions of the embodiments of the present disclosure will be described in a clearly and fully understandable way in connection with the drawings related to the embodiments of the present disclosure. Apparently, the described embodiments are just a part but not all of the embodiments of the present disclosure. Based on the described embodiments of the present disclosure, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects.

In research, the inventors of the present application have found that there is no effective silencing device at the outer side of the power device (for example, including the driving machine and other devices) and the plunger pump in a common fracturing apparatus, that is, there is no good noise reduction device, so most apparatuses fail to meet the requirements of the oil and gas industry standard SY/T 7086. When a fracturing apparatus works with rated power, it is easy to generate high noise, which will lead to serious noise pollution during well site operation.

The embodiments of the present disclosure provide a fracturing apparatus, which includes a plunger pump, a transmission shaft, a main motor, an oil pipe, a first radiator and a noise reduction cabin. The main motor is spaced apart from the plunger pump, and the plunger pump is connected with the main motor through the transmission shaft; the oil pipe is connected with the plunger pump; the first radiator is spaced apart from the plunger pump, and the first radiator is configured to dissipate heat from oil in the oil pipe; at least part of the oil pipe, the main motor and the first radiator are all located at the inner side of the noise reduction cabin, and the plunger pump is located at the outer side of the noise reduction cabin. The noise reduction cabin provided in the fracturing apparatus can separate structures, such as the main motor and the first radiator, etc., from the plunger pump, which can not only reduce the noise generated by the structures, such as the main motor and the first radiator, etc., and reduce the interference between electrical components, but also reduce the risk that the structures, such as the main motor and the first radiator, etc., are damaged by high-pressure liquid.

The fracturing apparatus provided by the embodiments of the present disclosure will be described below with reference to the accompanying drawings.

Figure 2:
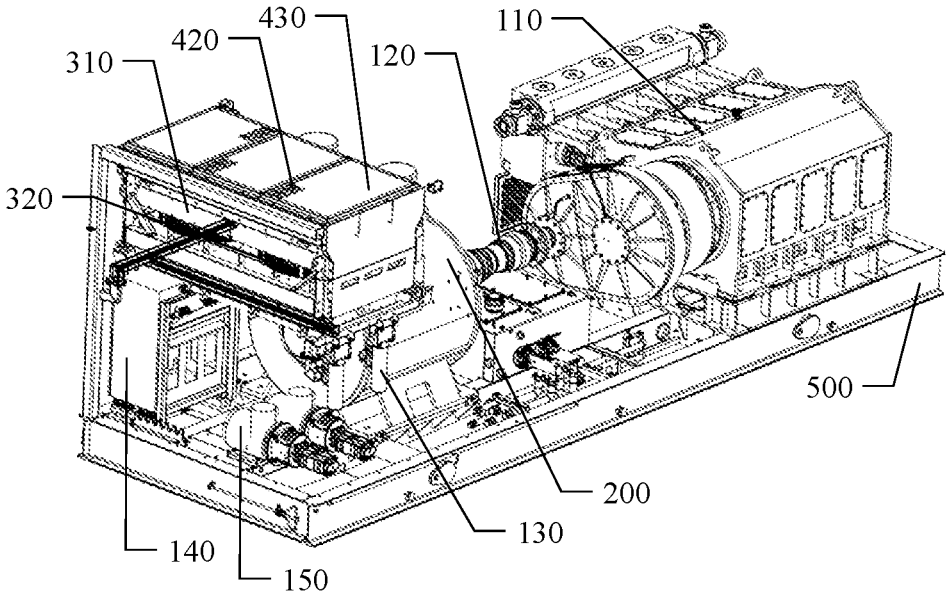
FIG. 2 is a schematic diagram of a partial structure of a fracturing apparatus according to an embodiment of the present disclosure.
Figure 3:
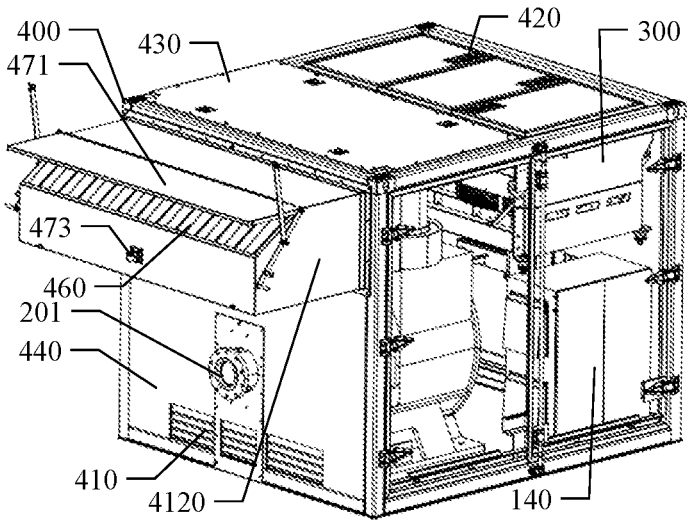
FIG. 3 is a schematic diagram of a noise reduction cabin and some devices in the noise reduction cabin of the fracturing apparatus shown in FIG. 1.

FIG. 1 is a side view of a partial structure of a fracturing apparatus according to an embodiment of the present disclosure. FIG. 2 is a schematic diagram of a partial structure of a fracturing apparatus according to an embodiment of the present disclosure, and FIG. 3 is a schematic diagram of a noise reduction cabin and some devices in the noise reduction cabin of the fracturing apparatus shown in FIG. 1. For example, in order to more clearly show each part of the noise reduction cabin, some cabin side walls or cabin doors of the noise reduction cabins shown in FIGS. 1 and 3 are omitted, and the overall appearance of the noise reduction cabin can refer to FIG. 4 described later.

As shown in FIGS. 1-3, the fracturing apparatus includes a plunger pump 110, a transmission shaft 120 and a main motor 200, and the main motor 200 is spaced apart from the plunger pump 110. For example, there is a certain distance between the main motor 200 and the plunger pump 110. For example, the main motor 200 can be an electric motor, the plunger pump 110 is connected with the main motor 200 through the transmission shaft 120, and the main motor 200 is configured to drive the plunger pump 110 to work through the transmission shaft 120. For example, the transmission shaft 120 is located between the plunger pump 110 and the main motor 200. For example, the plunger pump 110 includes a power end and a fluid end. The plunger reciprocates in the pump head body (valve box), which causes the change of the sealing volume in the pump head body to convey the fluid. For example, the power end includes a pump housing, a crankshaft and a crosshead assembly, etc., and is configured to reduce the rotating speed, to increase the torque, and to convert the rotating motion into reciprocating motion. For example, the fluid end includes a pump head body, a plunger and a valve, etc., and is configured to convert mechanical energy into fluid energy. For example, the main motor 200 is connected to the power end of the plunger pump 110 and is configured to provide power to the power end of the plunger pump 110.

As shown in FIGS. 1-3, the fracturing apparatus further includes an oil pipe 130 which is configured to be connected with the plunger pump 110. For example, the oil pipe 130 is configured to transmit lubricating oil, and the lubricating oil is configured to lubricate components in the power end of the plunger pump 110. For example, the fracturing apparatus further includes a lubricating motor 150 and a lubricating pump, the oil pipe 130 is connected with the lubricating pump, the lubricating motor 150 provides power to the lubricating pump to drive the lubricating pump to run. After the lubricating pump runs, the lubricating oil flows into the oil pipe 130. After flowing through the power end of the plunger pump 110, the lubricating oil in the oil pipe 130 will return to the lubricating oil tank. For example, the lubricating pump can be immersed in the lubricating oil in the lubricating oil tank.

As shown in FIGS. 1-3, the fracturing apparatus further includes a first radiator 300 spaced apart from the plunger pump 110, and the first radiator 300 is configured to dissipate heat from the oil in the oil pipe 130. For example, the first radiator 300 can be a lubricating oil radiator configured to dissipate heat from the lubricating oil in the oil pipe 130. For example, the first radiator 300 can include a heat dissipation pipe 310, the heat dissipation pipe 310 includes an oil inlet and an oil outlet, and the oil inlet and the oil outlet are respectively connected with the oil pipe 130. The lubricating oil transmitted in the oil pipe 130 flows into the heat dissipation pipe 310 through the oil inlet of the heat dissipation pipe 310, and then flows into the oil pipe 130 from the oil outlet of the heat dissipation pipe 310 after heat dissipation through the heat dissipation pipe 310. For example, the first radiator 300 can be located on the oil inlet pipeline of the plunger pump 110 or on the oil outlet pipeline of the plunger pump 110.

As shown in FIGS. 1-3, the fracturing apparatus further includes a noise reduction cabin 400, and the main motor 200, the first radiator 300 and at least part of the oil pipe 130 are located at the inner side of the noise reduction cabin 400, and the plunger pump 110 is located at the outer side of the noise reduction cabin 400.

The plunger pump will produce a high pressure of nearly 15000 Psi in the working process. Once the high-pressure liquid leaks, it will produce great destructive power. The fracturing apparatus provided by the present disclosure is provided with a noise reduction cabin, which can separate structures, such as the main motor and the first radiator, etc., from the plunger pump, thus not only reducing the noise generated by the structures, such as the main motor and the first radiator, etc., and reducing the interference between electrical components, but also reducing the risk that the structures, such as the main motor and the first radiator, etc., are damaged by high-pressure liquid.

For example, as shown in FIGS. 1-3, the noise reduction cabin 400 includes at least one cabin side wall 440. For example, one cabin side wall 440 is arranged between the main motor 200 and the plunger pump 110, and the cabin side wall 440 can be provided with an opening, the transmission shaft 120 passes through the opening to connect with the main motor 200. For example, a flange 201 is provided at the opening for connection with the transmission shaft 120.

For example, as shown in FIGS. 1-3, the lubricating motor 150 is located in the noise reduction cabin 400. The noise reduction cabin 400 can not only reduce the noise of the lubricating motor 150, but also reduce the risk of the lubricating motor 150 being damaged by high-pressure liquid.

For example, as shown in FIGS. 1-3, the fracturing apparatus further includes a platform 500, and the plunger pump 110, the main motor 200 and the noise reduction cabin 400 are all located on the supporting surface of the platform 500. For example, the platform 500 can be a skid-mounted platform. For example, the supporting surface can be a plane perpendicular to the Y direction shown in FIG. 1. The supporting surface is defined as such a plane to better illustrate the positional relationship between other structures and the plane where the supporting surface is located, but it does not mean that the surface of the platform facing the main motor must be a plane. For example, in the case where the surface of the platform has convex structures, the supporting surface as a plane can be a plane located at the bottom of these convex structures or a plane passing through a point on the surface of the platform. In the direction perpendicular to the supporting surface, the direction from the opposite side of the supporting surface of the platform to the supporting surface is called the upward direction (that is, the direction indicated by the arrow in the X direction), and the direction from the supporting surface to the opposite side of the supporting surface of the platform is called the downward direction. In the direction parallel to the supporting surface, the direction from the edge of the noise reduction cabin to the center of the noise reduction cabin is called the inward direction, and the direction from the center of the noise reduction cabin to the edge of the noise reduction cabin is called the outward direction. Therefore, the relative positional relationships indicated by "inner" and "outer" also have a clear meaning.

For example, as shown in FIGS. 1-3, the noise reduction cabin 400 includes an air inlet 410 and an air outlet 420, and the distance between the air outlet 420 and the supporting surface of the platform 500 is greater than the distance between the air inlet 410 and the supporting surface. For example, the air outlet 420 is located on the upper side of the air inlet 410. The distance between the air outlet and the supporting surface can indicate the distance between the end or surface of the air outlet closest to the supporting surface and the supporting surface, and the distance between the air inlet and the supporting surface can indicate the distance between the end or surface of the air inlet closest to the supporting surface and the supporting surface. By arranging the air outlet on the upper side of the air inlet, the air in the external environment can blow through the components, such as the main motor and the first radiator, etc., during the process of spreading upward (to the air outlet) from the air inlet, which is beneficial to the cooling of the components, such as the main motor and the first radiator, etc. In addition, by arranging the air outlet on the upper side of the air inlet, it is also beneficial to reducing the reflection and transmission of noise among the devices in the noise reduction cabin, thus being beneficial to reducing the noise.

For example, as shown in FIGS. 1-3, the noise reduction cabin 400 includes a cabin top wall 430. The cabin top wall 430 refers to a cabin wall farthest from the platform 500 in the noise reduction cabin 400. For example, the cabin top wall 430 is closer to the first radiator 300 than the platform 500. By arranging the first radiator closer to the cabin top wall, it can be beneficial for the first radiator to blow upward to dissipate heat, and it can achieve better noise reduction effect while dissipating heat form the lubricating oil.

For example, as shown in FIGS. 1-3, the lubricating motor 150 can be located at a side of the main motor 200 away from the plunger pump 110. For example, the lubricating motor 150 can be located between the first radiator 300 and the platform 500. For example, the orthographic projection of the lubricating motor 150 on the supporting surface of the platform 500 overlaps with the orthographic projection of the first radiator 300 on the supporting surface. For example, the first radiator 300 is located directly above the lubricating motor 150.

In the fracturing apparatus provided by the present disclosure, the first radiator is arranged closer to the cabin top wall, and other device (such as the lubricating motor) is arranged between the first radiator and the platform, which can improve the utilization rate of the space in the noise reduction cabin.

For example, as shown in FIGS. 1-3, the first radiator 300 can be arranged on the frame of the noise reduction cabin 400. For example, the first radiator 300 can be arranged on the cabin body of the noise reduction cabin 400, and the main motor 200 and the lubricating motor 150 are covered in the cabin body by the noise reduction cabin 400.

For example, as shown in FIGS. 1-3, the first radiator 300 is located at a side of the main motor 200 away from the plunger pump 110, a second radiator 210 is provided at a side of the main motor 200 away from the platform 500, the second radiator 210 is configured to dissipate heat from the main motor 200, and the cabin top wall 430 is closer to the second radiator 210 than the platform 500. For example, the second radiator 210 can be a cooling fan.

For example, as shown in FIGS. 1-3, both the first radiator 300 and the second radiator 210 are located close to the cabin top wall 430, which is favorable for dissipating heat from the lubricating oil and the main motor. For example, a straight line parallel to the supporting surface of the platform 500 can pass through the first radiator 300 and the second radiator 210. For example, the orthographic projections of the first radiator 300 and the second radiator 210 on a straight line perpendicular to the supporting surface overlap with each other.

The embodiment of the present disclosure illustratively takes the second radiator as a component separated from the main motor, but it is not limited to this case, and the second radiator can also be integrated with the main motor.

For example, as shown in FIGS. 1-3, the cabin top wall 430 is provided with an air outlet 420, the first radiator 300 includes a heat dissipation pipe 310 and a fan 320, the heat dissipation pipe 310 is located between the fan 320 and the air outlet 420, the fan 320 is configured to blow air to the heat dissipation pipe 310 to dissipate heat from the lubricating oil in the heat dissipation pipe 310, and the heat dissipation pipe 310 is opposite to the air outlet 420, so that the heat of the lubricating oil in the heat dissipation pipe 310 is directly discharged outside the cabin. For example, the heat dissipation pipe 310 is located above the fan 320, that is, at a side of the fan 320 away from the platform 500. For example, the air outlet 420 can have a mesh structure.

For example, as shown in FIGS. 1-3, the fan 320 is configured to blow and dissipate heat from the lubricating oil flowing in the heat dissipation pipe 310, that is, the fan 320 blows the heat dissipation pipe 310 above it, so as to discharge the heat outside the cabin from the air outlet 420. In the process that the fan 320 blows upward, negative pressure is formed inside the noise reduction cabin 400, and the external air enters the noise reduction cabin 400 from the air inlet 410, and flows to the air outlet 420 after passing through the devices in the noise reduction cabin 400 (such as the main motor 200 and the lubricating motor 150, etc.), so as to cool the devices in the noise reduction cabin 400 and ensure the normal operation of the devices in the cabin. This process meets the air quantity required by the devices when working and the air quantity required for heat dissipation. In addition, the air outlet is arranged on the cabin top wall of the noise reduction cabin, so that the air outlet is located above the devices in the cabin, and the reflection and transmission of noise among the devices can be weakened.

Figure 4:
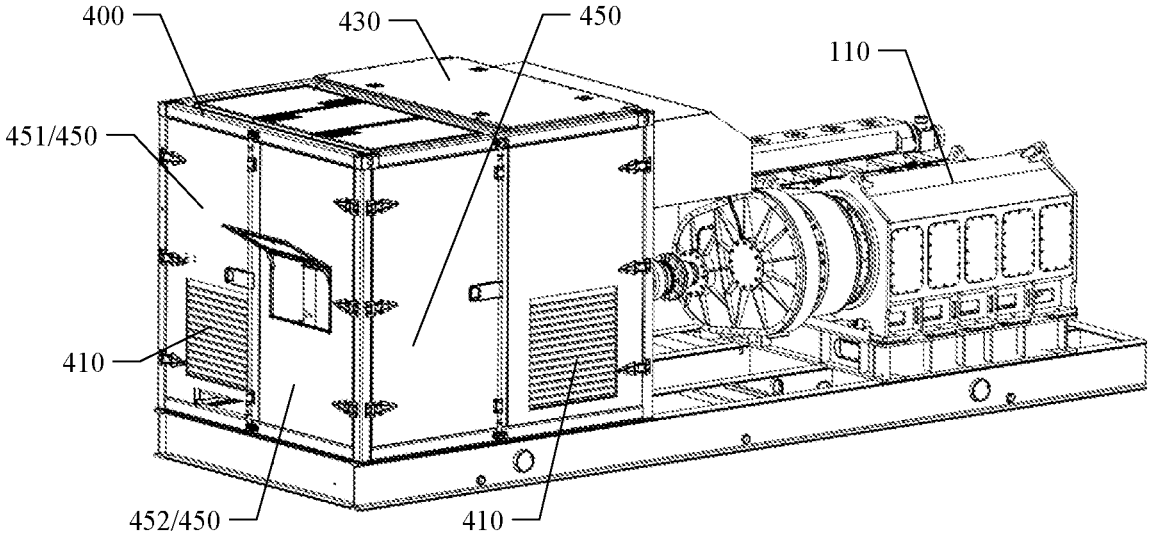
FIG. 4 is a schematic view from one side corresponding to the fracturing apparatus shown in FIG. 1.

For example, FIG. 4 is a schematic view from one side corresponding to the fracturing apparatus shown in FIG. 1. As shown in FIGS. 1-4, the noise reduction cabin 400 includes a cabin side wall 440 and a cabin door 450, and at least one of the cabin side wall 440 and the cabin door 450 is provided with an air inlet 410. For example, the noise reduction cabin 400 can include four side surfaces and a top surface, the top surface is provided with a cabin top wall, one of the four side surfaces is provided with the cabin side wall 440, the other three of the four side surfaces are provided with cabin doors 450, and each side surface can be provided with two cabin doors 450. Thus, the noise reduction cabin 400 can include one cabin top wall 430, one cabin side wall 440 and six cabin doors 450, and the cabin side wall 440 is located between the main motor 200 and the plunger pump 110. For example, the cabin side wall 440 is provided with the air inlet 410, and the three side surfaces where the cabin doors 450 are provided can all be provided with air inlets 410. Therefore, the external air can enter the noise reduction cabin 400 from four different directions, which is more conducive to cooling the devices in the cabin.

For example, as shown in FIGS. 1-4, two cabin doors 450 on the same side can be provided with air inlets 410, or one of the two cabin doors 450 on the same side can be provided with an air inlet 410.

FIG. 4 illustratively shows that the noise reduction cabin includes four side surfaces, but it is not limited to this case, and it may also include five or more side surfaces. For example, in the case where the noise reduction cabin includes four side surfaces, the number of side surfaces where the cabin side walls are arranged can be two, and the number of side surfaces where the cabin doors are arranged can be two; or, the number of side surfaces where the cabin side walls are arranged can be three, and the number of side surfaces where the cabin doors are arranged can be one, without being limited in the embodiment of the present disclosure. For example, FIG. 4 illustratively shows that each side surface includes two cabin doors, but it is not limited to this case, and it may also include one cabin door or more cabin doors.

For example, the areas of the air inlets 410 on different cabin doors 450 and the area of the air inlet 410 on the cabin side wall 440 can be the same or different.

For example, the air inlet 410 on the cabin side wall 440 can be directly opposite to the main motor 200, and the external air entering from the air inlet 410 can cool the main motor 200. A part of the air inlet 410 provided on the cabin door 450 which is close to both the main motor 200 and the lubricating motor 150 can be directly opposite to the main motor 200, and the other part of the air inlet 410 can be directly opposite to the lubricating motor 150, and the external air entering from the air inlet 410 can simultaneously cool the main motor 200 and the lubricating motor 150.

For example, as shown in FIGS. 1-3, the fracturing apparatus further includes an electric control cabinet 140, and the electric control cabinet 140 is located in the noise reduction cabin 400, thereby not only reducing the noise generated by the electric control cabinet, but also reducing the risk that the electric control cabinet is damaged by high-pressure liquid in the plunger pump.

For example, as shown in FIGS. 1-3, the main motor 200 is located between the electric control cabinet 140 and the plunger pump 110. For example, the main motor 200 can be electrically connected with electrical devices in the electric control cabinet 140. For example, a frequency converter 141 is provided in the electric control cabinet 140, and the main motor 200 can be electrically connected with the frequency converter 131. For example, the lubricating motor 150 and other devices can also be connected with cables from the frequency converter 141 in the electric control cabinet 140.

For example, the electric control cabinet 140 is located between the first radiator 300 and the platform 500, and the orthographic projection of the electric control cabinet 140 on the supporting surface of the platform 500 overlaps with the orthographic projection of the first radiator 300 on the supporting surface. For example, the electric control cabinet 140 and the lubricating motor 150 are both arranged on the platform 500 and both located between the first radiator 300 and the platform 500, which can effectively utilize the space in the noise reduction cabin.

For example, the external air entering from the air inlet 410 on the cabin door 450 adjacent to the electric control cabinet 140 can cool the electric control cabinet 140.

Figure 5:
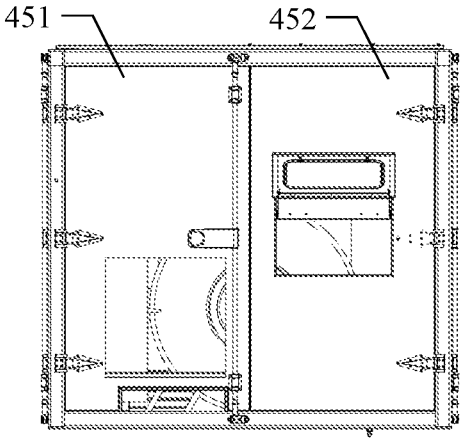
FIG. 5 is a schematic view of a cabin door located at a side of a main motor away from a plunger pump in the noise reduction cabin shown in FIG. 4.

For example, FIG. 5 is a schematic view of a cabin door located at a side of a main motor away from a plunger pump in the noise reduction cabin shown in FIG. 4. As shown in FIGS. 1-5, two cabin doors 450 located at a side of the main motor 200 away from the plunger pump 110, after being opened, can expose the electric control cabinet 140, the lubricating motor 150 and the first radiator 300. For example, the two doors 450, after being opened, can further expose a filter, and the filter is configured to filter the lubricating oil in the oil pipe. For example, the filter can be connected in the pipeline of oil pipe for transporting lubricating oil, and the lubricating oil flowing through the filter can be filtered by the filter. For example, the filter can be located on the oil inlet pipeline of the plunger pump 110 or on the oil outlet pipeline of the plunger pump 110.

For example, as shown in FIGS. 1-5, two cabin doors 450 located at a side of the main motor 200 away from the plunger pump 110 include a first cabin door 451 and a second cabin door 452, the first cabin door 451 is configured to expose the electric control cabinet 140 upon being opened, and the second cabin door 452 is configured to expose the lubricating motor 150 upon being opened. For example, the second cabin door 452 can further expose the filter as mentioned above upon being opened. For example, a part of the first radiator 300 can be exposed after the first cabin door 451 is opened, and the other part of the first radiator 300 can be exposed after the second cabin door 452 is opened.

For example, in the case where the two cabin doors 450 are closed, the second cabin door 452 overlaps with the first cabin door 451. For example, the part of the first cabin door 451 close to the second cabin door 452 overlaps with the part of the second cabin door 452 close to the first cabin door 451. For example, the overlapping part of the second cabin door 452 is located at the outer side of the overlapping part of the first cabin door 451. For example, a part of the second cabin door 452 is pressed against the outer side of a part of the first cabin door 451, so that the first cabin door 451 can be opened only after the second cabin door 452 is opened.

For example, the maintenance frequency of the electric control cabinet 140 is lower than the maintenance frequency of the lubricating motor 150. For example, the maintenance frequency of the electric control cabinet 140 is lower than the maintenance frequency of the filter. In order to facilitate the maintenance operations of the devices in the noise reduction cabin 400, the electric control cabinet 140 can be placed behind the first cabin door 451, and other devices with higher maintenance frequency, such as the lubricating motor 150 and the filter, etc., can be placed behind the second cabin door 452, and the cabin door 450 is arranged in such a way that part of the second cabin door 452 is pressed against the outer side of part of the first cabin door 451, so that only the second cabin door 452 needs to be opened to meet the small-scale maintenance of devices, such as the lubricating motor and the filter, etc.

For example, the first cabin door 451 and/or the second cabin door 452 can further be provided with transparent windows or nested small doors. Through the transparent window, the components inside the noise reduction cabin can be observed; or by opening the nested small door, the components in the noise reduction cabin can be simply maintained without opening the first cabin door 451 and/or the second cabin door 452.

For example, one of the first cabin door 451 and the second cabin door 452 can further be provided with a touch screen, and the touch screen is connected with the electric control cabinet to control the working state of the devices in the noise reduction cabin 400.

Another embodiment of the present disclosure provides a fracturing apparatus, which includes a plunger pump, a transmission shaft, a main motor, a second radiator and a platform. The main motor is spaced apart from the plunger pump, and the plunger pump is connected with the main motor through the transmission shaft; the second radiator is configured to dissipate heat from the main motor; and the plunger pump and the main motor are both located on the platform. The fracturing apparatus further includes a noise reduction cabin located on the platform, the main motor and the second radiator are both located in the noise reduction cabin; the noise reduction cabin is provided with a noise reduction structure, the noise reduction structure is configured to reduce the noise of the second radiator; and a distance between an end or a plane of the noise reduction structure farthest from the platform and the platform is not less than the distance between the second radiator and the platform. In the fracturing apparatus provided by the embodiment of the present disclosure, the main motor and the second radiator used to dissipate heat from the main motor are arranged in the noise reduction cabin, and the noise reduction structure used to reduce the noise of the second radiator is arranged in the noise reduction cabin, which is beneficial to improving the noise reduction effect of the main motor and the second radiator in the fracturing apparatus. In addition, by setting the relative positional relationship between the noise reduction structure and the second radiator, the noise of the second radiator can be discharged to a side away from the platform, which is beneficial to reducing the reflection and transmission of the noise among the devices in the noise reduction cabin and further reducing the noise.

Figure 6:
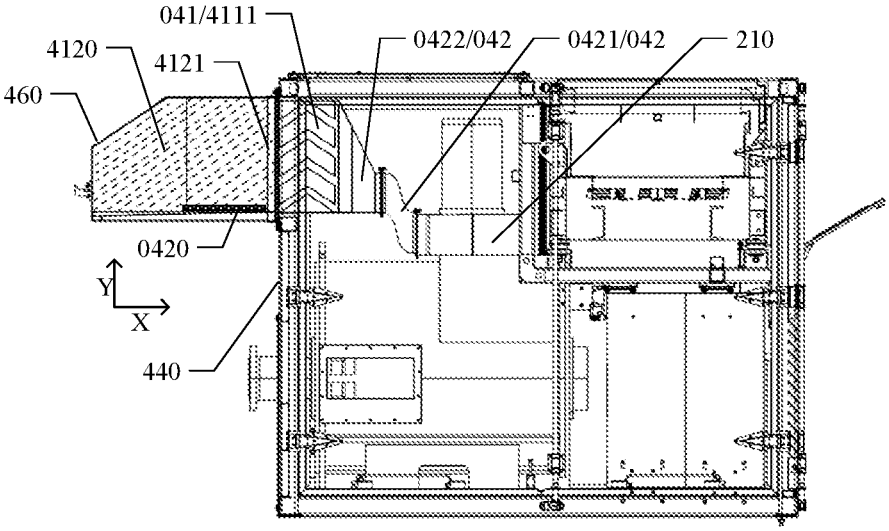
FIG. 6 is a partial cross-sectional structural view of the noise reduction cabin of the fracturing apparatus shown in FIG. 1.

FIG. 6 is a partial cross-sectional structural view of the noise reduction cabin of the fracturing apparatus shown in FIG. 1. As shown in FIGS. 1 and 6, the second radiator 210 is configured to dissipate heat from the main motor 200. For example, the second radiator 210 is located at the top of the main motor 200, the fan blades included in the second radiator 210 operate (suction type), and the external air enters the noise reduction cabin through the shutters of the noise reduction cabin (described later), then passes through the air inlet at the bottom of the main motor 200, takes away a part of the heat through the main motor cavity (stator and rotor), and then is discharged to the air outlet of the cabin body through the volute and the fan blades, thus realizing the heat dissipation of the main motor 200.

For example, as shown in FIGS. 1 and 6, the second radiator 210 is located at a side of the main motor 200 away from the platform 500. The embodiment of the present disclosure illustratively shows that the second radiator and the main motor are two components separated from each other, but it is not limited to this case, and the second radiator and the main motor can also have an integrated structure, and they can be integrated as a whole.

As shown in FIGS. 1 and 6, both the main motor 200 and the second radiator 210 are located in the noise reduction cabin 400, the noise reduction cabin 400 is provided with a noise reduction structure 4100, the noise reduction structure 4100 is configured to reduce the noise of the second radiator 210, and at least part of the noise reduction structure 4100 is located at a side of the second radiator 210 away from the platform 500. In the fracturing apparatus, the second radiator configured to dissipate heat from the main motor is the key component to generate noise. In the fracturing apparatus provided by the present disclosure, the main motor and the second radiator for dissipating heat from the main motor are arranged in the noise reduction cabin, and the noise reduction structure for reducing noise of the second radiator is arranged in the noise reduction cabin, which is beneficial to improving the noise reduction effect of the main motor and the second radiator of the fracturing apparatus.

For example, as shown in FIGS. 1 and 6, the direction indicated by the arrow in the Y direction is upward, and at least part of the noise reduction structure 4100 is obliquely above the second radiator 210. For example, at least part of the noise reduction structure 4100 is obliquely above the fan of the second radiator 210.

In the fracturing apparatus provided by the present disclosure, by setting the relative positional relationship among the noise reduction structure, the second radiator and the platform, the noise of the second radiator can be discharged to a side away from the platform, which is beneficial to reducing the reflection and transmission of the noise among the devices in the noise reduction cabin and reducing the noise.

For example, as shown in FIGS. 1 and 6, the cabin top wall 430 can be parallel to the supporting surface of the platform 500, but it is not limited thereto. In the present disclosure, "parallel to" means that the angle therebetween is not greater than 10 degrees.

For example, as shown in FIGS. 1 and 6, the cabin top wall 430 is closer to the second radiator 210 than the platform 500. For example, the distance between the fan of the second radiator 210 and the cabin top wall 430 can be less than the distance between the fan and the platform 500. By arranging the second radiator closer to the cabin top wall, it can be beneficial for the second radiator to discharge noise upwards, so as to achieve better noise reduction effect.

For example, as shown in FIGS. 1 and 6, the noise reduction cabin 400 further includes a cabin side wall 440, and the cabin side wall is a cabin wall intersected with the supporting surface of the platform 500 in the noise reduction cabin, for example, the cabin side wall 440 can contact with the platform 500 and be fixed on the platform 500. For example, the noise reduction structure 4100 is disposed on at least one of the cabin top wall 430 and the cabin side wall 440.

For example, FIG. 1 illustratively shows that the noise reduction structure is arranged on the cabin side wall, which is beneficial to saving the space of the fracturing apparatus, but it is not limited to this case, and the noise reduction structure can also be arranged on the cabin top wall of the noise reduction cabin.

For example, as shown in FIGS. 1 and 6, the noise reduction structure 4100 includes a labyrinth noise reduction portion 4110. For example, as shown in FIGS. 1 and 6, the labyrinth noise reduction portion 4110 can include a plurality of baffle plates 4111; for example, each baffle plate 4111 can include a plurality of sub-portions 041 to form a bending portion, and the plurality of baffle plates 4111 form a labyrinth structure, so that the noise will be blocked by the baffle plates and refracted when it propagates, thus achieving the purpose of noise reduction.

For example, the labyrinth noise reduction portion 4110 can include a bent steel plate and sound-absorbing cotton adhered to the steel plate.

For example, as shown in FIGS. 1 and 6, the labyrinth noise reduction portion 4110 includes a plurality of baffle plates 4111 arranged in a direction perpendicular to the supporting surface of the platform 500, and a gap is provided between adjacent baffle plates 4111 for discharging noise. For example, each baffle plate 4111 includes at least two sub-portions 041 connected in sequence. FIG. 6 illustratively shows that each baffle plate 4111 includes two sub-portions 041 connected in sequence, but it is not limited thereto, and each baffle plate 4111 can also include three or more sub-portions.

For example, as shown in FIGS. 1-6, the sub-portions 041 included in each baffle plate 4111 can have an integrally formed structure. Of course, the embodiment of the present disclosure is not limited thereto, and the plurality of sub-portions included in at least one bending portion may not have an integrally formed structure.

For example, as shown in FIGS. 1 and 6, each baffle plate 4111 includes two sub-portions 041 connected in sequence, each baffle plate 4111 includes a first sub-portion close to the second radiator 210 and a second sub-portion away from the second radiator 210, a distance between an end of the first sub-portion close to the second radiator 210 and the platform 500 is less than a distance between an end of the first sub-portion away from the second radiator 210 and the platform 500, and a distance between an end of the second sub-portion close to the second radiator 210 and the platform 500 is greater than a distance between an end of the second sub-portion away from the second radiator 210 and the platform 500. For example, the first sub-portion and the second sub-portion form an inverted V-shape, and the shape of the gap between adjacent baffle plates 4111 also forms an inverted V-shape; the second radiator 210 is located obliquely below at least part of the gaps, and the noise generated by the second radiator 210 enters the inverted V-shape gap during upward propagation, and then is discharged to the outer side of the noise reduction cabin through these gaps.

FIG. 6 illustratively shows that the shape of the baffle plate included in the labyrinth noise reduction portion is a bent shape, but it is not limited thereto, and the baffle plate can also be in a plate shape of a cuboid.

For example, as shown in FIGS. 1 and 6, the noise reduction structure 4100 further includes a noise reduction channel 042 between the labyrinth noise reduction portion 4110 and the second radiator 210, and the noise reduction channel 042 connects the labyrinth noise reduction portion 4110 with the second radiator 210. For example, the labyrinth noise reduction portion 4110 is located obliquely above the fan of the second radiator 210. In this case, the noise reduction channel 042 extends obliquely upward from the second radiator 210 to be connected to the labyrinth noise reduction portion 4110, and the noise generated by the fan of the second radiator 210 propagates to the labyrinth noise reduction portion 4110 through the noise reduction channel 042. For example, the noise reduction channel 042 can include a first channel 0421 close to the second radiator 210 and a second channel 0422 away from the second radiator 210. For example, the second channel 0422 is connected with the labyrinth noise reduction portion 4110. For example, the second channel 0422 can be made of the same material as and integrally formed with the labyrinth noise reduction portion 4110. For example, the first channel 0421 can be made of a flexible material, such as a hose, so as to connect the second channel 0422 with the second radiator 210. For example, the first channel 0421 can send hot air to the second channel 0422. For example, the motor in the second radiator 210 will inevitably vibrate during operation, and the first channel 0421 adopts a flexible material to realize the soft connection between the second channel 0422 and the second radiator 210, which is beneficial to absorbing the vibration and improving the stability. For example, the noise reduction channel 042 can also be provided with a component for noise reduction, such as a sound-absorbing material, etc.

Of course, the embodiment of the present disclosure is not limited to that the noise generated by the fan of the second radiator propagates to the noise reduction structure, and the noise generated by the driving motor of the second radiator can also propagate to the noise reduction structure, and the noise reduction structure is configured to reduce the noise of the whole second radiator.

For example, as shown in FIGS. 1 and 6, the noise reduction structure 4100 can be arranged on the cabin side wall 440. For example, the noise reduction structure 4100 is located at the top of the cabin side wall 440 and contacts with the cabin top wall 430. However, it is not limited to this case. The noise reduction structure 4100 can also be located on the middle and upper part of the cabin side wall 440, that is, the cabin side wall 440 is arranged above and below the noise reduction structure 4100. For example, the noise reduction structure 4100 can be fixed on the cabin side wall 440.

For example, as shown in FIGS. 1 and 6, the noise reduction structure 4100 further includes a noise reduction cavity 4120, and for example, the noise reduction cavity 4120 can be an empty cavity. For example, a labyrinth noise reduction portion 4110 is arranged at the opening 4121 of the noise reduction cavity 4120 facing the main motor 200. For example, the labyrinth noise reduction portion 4110 is located between the noise reduction cavity 4120 and the second radiator 210, and the noise discharged from the labyrinth noise reduction portion 4110 will enter the noise reduction cavity 4120.

For example, as shown in FIGS. 1 and 6, the noise reduction cavity 4120 protrudes to a side away from the main motor 220 with respect to the cabin side wall 440 to form an empty cavity.

For example, as shown in FIGS. 1 and 6, the plunger pump 110 is located at the outer side of the noise reduction cabin 400, and the noise reduction structure 4100 is located between the main motor 200 and the plunger pump 110. For example, the noise reduction cavity 4120 protrudes outward relative to the cabin side wall 440 of the noise reduction cabin 400 facing the plunger pump 110, which is beneficial to saving the space of the fracturing apparatus. For example, as shown in FIGS. 1 and 6, the orthographic projection of the noise reduction cavity 4120 on the platform 500 overlaps with the orthographic projection of the transmission shaft 120 on the platform 500. For example, the orthographic projection of the noise reduction cavity 4120 on the platform 500 does not overlap with the orthographic projection of the plunger pump 110 on the platform 500.

For example, as shown in FIGS. 1-6, along the direction perpendicular to the XY plane, the width of the noise reduction cavity 4120 can be equal to the width of the cabin side wall 440 of the noise reduction cabin 400, so as to maximize the volume of the noise reduction cavity 4120 and further improve the noise reduction effect. The present disclosure is not limited to this case, and the width of the noise reduction cavity can also be less than the width of the cabin side wall of the noise reduction cabin, and the width of the noise reduction cavity can be set according to actual product requirements.

For example, as shown in FIGS. 1 and 6, the noise reduction cavity 4120 is located at a side of the main motor 200 away from the platform 500, so that the noise reduction cavity can discharge noise to a side away from the platform. For example, the orthographic projection of the noise reduction cavity 4120 on a straight line perpendicular to the supporting surface of the platform 500 does not overlap with the orthographic projection of the main motor 200 on the straight line. For example, the orthographic projection of the noise reduction cavity 4120 on the straight line perpendicular to the supporting surface of the platform 500 can overlap with the orthographic projection of the second radiator 210 on the straight line.

For example, as shown in FIGS. 1 and 6, an exhaust outlet 460 is provided at a side of the noise reduction cavity 4120 away from the main motor 200, and the exhaust outlet 460 is configured to exhaust the noise in the noise reduction cavity 4120 outside the noise reduction cabin. For example, as shown in FIGS. 1 and 6, the exhaust outlet 460 is located at the upper part of the noise reduction cavity 4120, so that the noise discharged into the noise reduction cavity 4120 by the second radiator 210 through the labyrinth noise reduction portion 4110 can be discharged from the upper part of the noise reduction cavity 4120. For example, the noise discharged into the noise reduction cavity 4120 through the labyrinth noise reduction portion 4110 can be reflected at least once in the noise reduction cavity 4120 and then discharged from the exhaust outlet 460, and the noise being reflected at least once by the noise reduction cavity can improve the noise reduction effect.

For example, as shown in FIGS. 1 and 6, a distance between an end of the exhaust outlet 460 close to the labyrinth noise reduction portion 4110 and the supporting surface of the platform 500 is greater than a distance between an end of the exhaust outlet 460 away from the labyrinth noise reduction portion 4110 and the supporting surface, so that the exhaust outlet 460 exhausts air obliquely upward away from the platform 500.

For example, the exhaust outlet 460 can be provided with silencing shutters, which can not only achieve better circulation and exhaust air, but also have a noise reduction effect.

For example, as shown in FIGS. 1 and 6, a first sound-absorbing layer 0420 is provided at the inner wall of the noise reduction cavity 4120, and the first sound-absorbing layer 0420 is configured to further reduce the noise exited from the labyrinth noise reduction portion 4110.

For example, the first sound-absorbing layer 0420 can include a sound-absorbing material and a porous plate, the sound-absorbing material can include glass wool, the noise is reflected between the porous plate and the glass wool for multiple times, and after the aperture and pitch of the porous plate are determined, resonance attenuation can occur to achieve the noise reduction effect.

For example, the labyrinth noise reduction portion 4110 and the noise reduction cavity 4120 can work together to make the noise value at the outer side of the cabin meet the requirements. For example, after the noise reduction structure set in the noise reduction cabin reduces the noise of the devices, such as the second radiator, etc., the fracturing apparatus can meet the requirements of SY/T 7086 fracturing pumping apparatus.

Figure 7:
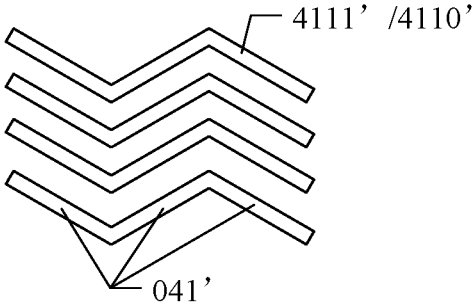
FIG. 7 is a partial cross-sectional structural view of a labyrinth noise reduction portion according to another example in the embodiment of the present disclosure.

For example, FIG. 7 is a partial cross-sectional structural view of a labyrinth noise reduction portion according to another example in the embodiment of the present disclosure. The labyrinth noise reduction portion 4110' shown in FIG. 7 can replace at least one of the labyrinth noise reduction portion 4110 and the noise reduction cavity 4120 shown in FIG. 6. Combining the components, other than the labyrinth noise reduction portion 4110 and the noise reduction cavity 4120 in FIG. 6, with the labyrinth noise reduction portion 4110' shown in FIG. 7, the labyrinth noise reduction portion 4110' includes a plurality of baffle plates 4111' arranged in the direction perpendicular to the supporting surface of the platform, each baffle plate 4111' includes at least two sub-portions 041' connected in sequence to form a bending portion, and a gap is arranged between adjacent baffle plates 4111'. In each baffle plate 4111', the sub-portion 041' farthest from the second radiator 210 extends in a direction away from the platform 500, so as to discharge noise from the cabin obliquely upward away from the platform 500.

For example, FIG. 7 illustratively shows that each baffle plate 4111' includes three sub-portions 041' connected in sequence, but it is not limited to this case, and the number of sub-portions in each baffle plate can be two or more.

For example, the labyrinth noise reduction portion 4110' shown in FIG. 7 can replace only the labyrinth noise reduction portion shown in FIG. 6, and for example, the labyrinth noise reduction portion 4110' shown in FIG. 7 can be combined with the noise reduction cavity 4120 shown in FIG. 6 to achieve the noise reduction effect together.

Figure 8:
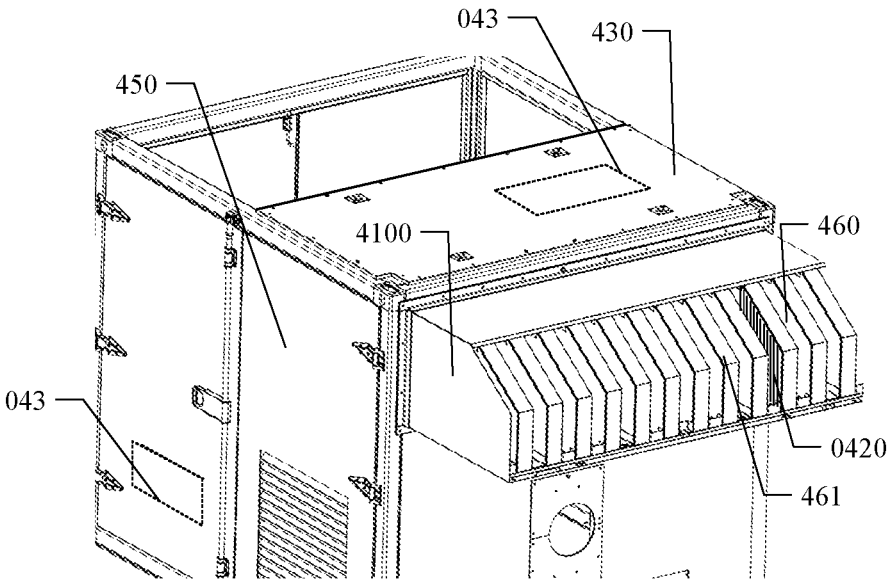
FIG. 8 is a schematic view of one side corresponding to the noise reduction cabin shown in FIG. 6.

For example, FIG. 3 is a schematic view from one side corresponding to the noise reduction cabin shown in FIG. 6, and FIG. 8 is a schematic view from the other side corresponding to the noise reduction cabin shown in FIG. 6. As shown in FIGS. 3 and 8, a second sound-absorbing layer 043 is provided at a side, facing the interior of the noise reduction cabin 400, of at least one of the cabin top wall 430, the cabin side wall 440 and the cabin door 450.

For example, in addition to the main motor 200 and the second radiator 210, devices, such as an oil radiator, a lubricating motor, an electric control cabinet, etc., are also provided in the noise reduction cabin. The noise generated by various devices in the noise reduction cabin 400 propagates around in the interior of the noise reduction cabin 400 and is absorbed by the second sound-absorbing layer 043 arranged in the cabin, thus achieving a better noise reduction effect.

For example, the second sound-absorbing layer 043 can include a sound-absorbing material and a porous plate, the sound-absorbing material can include glass wool, the noise is reflected between the porous plate and the glass wool for multiple times, and after the aperture and pitch of the porous plate are determined, resonance attenuation can occur to achieve the noise reduction effect.

For example, as shown in FIG. 3, the exhaust outlet 460 is provided with a cover plate 471. After the fracturing apparatus is turned off, the cover plate 471 can be covered on the exhaust outlet 460 to prevent external rain or snow from floating into the noise reduction cavity 4120 through the exhaust outlet 460 in rainy or snowy weather or to prevent other impurities from falling into the noise reduction cavity 4120 through the exhaust outlet.

Figure 9:
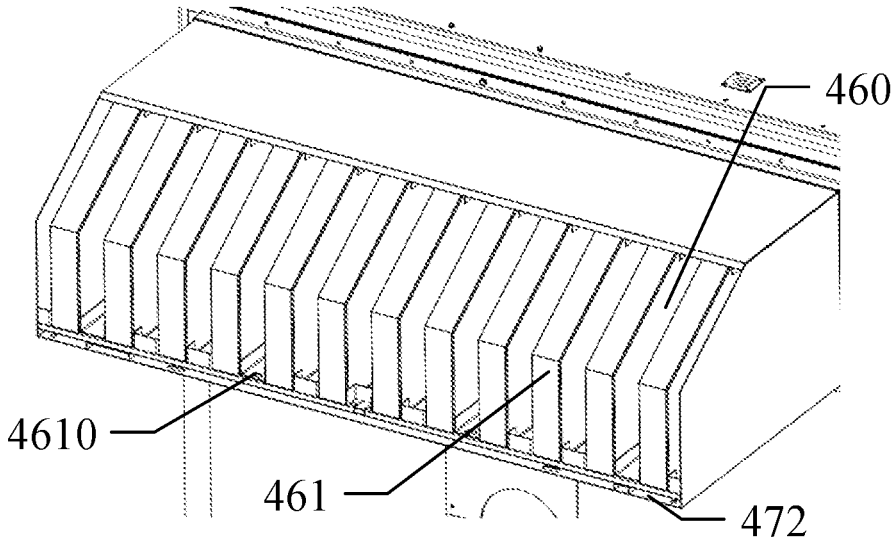
FIG. 9 is an enlarged view of a supporting plate and an exhaust outlet in the noise reduction cabin shown in FIGS. 8.
Figure 10:
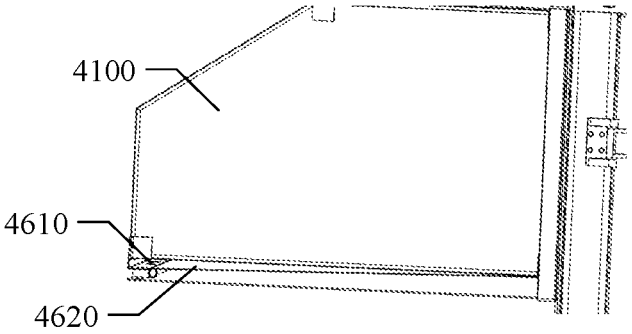
FIG. 10 is a side view of the exhaust outlet shown in FIG. 9.

For example, FIG. 9 is an enlarged view of a supporting plate and an exhaust outlet in the noise reduction cabin shown in FIG. 8, and FIG. 10 is a side view of the exhaust outlet shown in FIG. 9. As shown in FIGS. 3 and 8-10, a flow guide groove 472 is provided at a side of the noise reduction cavity 4120 close to the platform 500. When liquid, such as rain, enters the cavity through the exhaust outlet 460 provided in the noise reduction cavity 4120, the liquid can be discharged from the noise reduction cavity 4120 through the flow guide groove 472.

For example, as shown in FIGS. 3 and 8-10, at least one drain hole 4610 can be provided at the bottom of the noise reduction cavity 4120 close to the platform 50, and the drain hole 4610 can be communicated with the flow guide groove 472. When liquid enters the noise reduction cavity 4120, the liquid flows into the flow guide groove 472 through the drain hole 4610 and flows out from the flow guide groove 472.

For example, as shown in FIGS. 3 and 8-10, the drain hole 4610 and the flow guide groove 472 can both be arranged at a side of the noise reduction cavity 4120 away from the second radiator 210.

For example, as shown in FIGS. 3 and 8-10, the drain holes 4610 can be uniformly distributed at the bottom of the noise reduction cavity 4120, the flow guide groove 472 includes a flow guide pipe 4620 communicated with the drain holes 4610, the flow guide pipe 4620 discharge the liquid into the flow guide groove 472, and then the flow guide groove 472 discharges the liquid. For example, the above-mentioned flow guide pipe 4620 includes an inclined plane, a distance between a side of the inclined plane close to the second radiator 210 and the platform 500 is greater than a distance between a side of the inclined plane away from the second radiator 210 and the platform 500. The inclined plane can be used as a pipeline for transporting liquid and transport liquid to one side farthest from the second radiator 210, at least one drain hole 4610 is also arranged at a side of the inclined plane farthest from the second radiator 210, and the flow guide groove 472 is arranged at one side of the flow guide pipe 4620 farthest from the second radiator 210 and is communicated with the drain hole 4610.

For example, as shown in FIGS. 1-4, a hook 473 is provided at a surface of the noise reduction cavity 4120 away from the main motor 200, and the hook 473 overlaps with the transmission shaft 120 in the direction perpendicular to the supporting surface of the platform 500. For example, the hook 473 can be an auxiliary hook for hoisting the transmission shaft.

In the embodiment of the present disclosure, by arranging the auxiliary hook for hoisting the transmission shaft at the outer side of the noise reduction cabin, for example, at the outer side of the noise reduction cavity, the transmission shaft can be hoisted and stopped at the installation position with the help of the hook arranged on the noise reduction cabin when the transmission shaft is disassembled and assembled, so that the installation difficulty is reduced.

For example, as shown in FIGS. 3 and 8-9, a plurality of supporting plates arranged along the extending direction of the noise reduction cavity 4120 are provided at one side of the noise reduction cavity 4120 away from the labyrinth noise reduction portion 4110. A gap is provided between adjacent supporting plates 461, and a plurality of gaps formed by the plurality of supporting plates 461 form an exhaust outlet 460.

For example, a noise reduction component (e.g., the first sound-absorbing layer 0420), such as a sound-absorbing material and a porous plate, etc., can be provided on the surface of at least one supporting plate 461 to further reduce noise. For example, a first sound-absorbing layer 0420 can be provided on the surface of each supporting plate 461.

In the embodiment of the present disclosure, by arranging a plurality of supporting plates at a side of the noise reduction cavity away from the second radiator, a noise reduction type exhaust outlet can be formed, and at the same time, the load-bearing capacity of the noise reduction cavity can be improved, so that the load-bearing capacity of the auxiliary hook for hoisting the transmission shaft can be improved, and the disassembly and assembly of the transmission shaft can be facilitated.

The following statements should be noted:

(1) In the accompanying drawings of the embodiments of the present disclosure, the drawings involve only the structure(s) in connection with the embodiment(s) of the present disclosure, and other structure(s) can be referred to common design(s).

(2) In case of no conflict, features in one embodiment or in different embodiments can be combined.

What have been described above are only specific implementations of the present disclosure, the protection scope of the present disclosure is not limited thereto, and the protection scope of the present disclosure should be based on the protection scope of the claims

What is claimed is:

1. A fracturing apparatus, comprising:

a plunger pump;

a transmission shaft;

a main motor, spaced apart from the plunger pump, the plunger pump being connected with the main motor through the transmission shaft;

an oil pipe, configured to be connected with the plunger pump;

a first radiator, spaced apart from the plunger pump, the first radiator being configured to dissipate heat from oil in the oil pipe; and a noise reduction cabin, wherein the main motor, the first radiator and at least part of the oil pipe are all located inside the noise reduction cabin, and the plunger pump is located outside the noise reduction cabin, wherein the noise reduction cabin comprises a cabin top wall, a cabin side wall, and a cabin door, wherein the cabin side wall is disposed between the plunger pump and the main motor and has an external surface facing the plunger pump, wherein the noise reduction cabin comprises a noise reduction structure extending from the cabin side wall toward the plunger pump, wherein an orthographic projection of the noise reduction structure overlaps with an orthographic projection of a portion of the transmission shaft that extends between the plunger pump and the cabin side wall.

2. The fracturing apparatus according to claim 1, further comprising a platform, wherein the plunger pump, the main motor and the noise reduction cabin are all located on a supporting surface of the platform, the noise reduction cabin comprises an air inlet and an air outlet, and a distance between the air outlet and the supporting surface is greater than a distance between the air inlet and the supporting surface.

3. The fracturing apparatus according to claim 2, wherein the cabin top wall is closer to the first radiator than the platform, and the first radiator is located at a side of the main motor away from the plunger pump.

4. The fracturing apparatus according to claim 3, wherein the cabin top wall is provided with the air outlet, the first radiator comprises a heat dissipation pipe and a fan, the heat dissipation pipe is located between the fan and the air outlet, and the fan is configured to blow air to the heat dissipation pipe to dissipate heat.

5. The fracturing apparatus according to claim 3, wherein a second radiator is provided at a side of the main motor away from the platform, and the second radiator is configured to dissipate heat from the main motor;

the noise reduction structure is configured to reduce noise of the second radiator, and at least part of the noise reduction structure is located at a side of the second radiator away from the platform.

6. The fracturing apparatus according to claim 5, wherein the cabin top wall is closer to the second radiator than to the platform.

7. The fracturing apparatus according to claim 5, wherein the noise reduction structure is arranged on the cabin side wall.

8. The fracturing apparatus according to claim 7, wherein the noise reduction structure comprises a labyrinth noise reduction portion, and the labyrinth noise reduction portion comprises a plurality of baffle plates.

9. The fracturing apparatus according to claim 8, wherein the noise reduction structure further comprises a noise reduction cavity, the labyrinth noise reduction portion is arranged at an opening of the noise reduction cavity facing the main motor, and an exhaust outlet is provided at a side of the noise reduction cavity away from the main motor.

10. The fracturing apparatus according to claim 9, wherein the noise reduction structure is located between the main motor and the plunger pump.

11. The fracturing apparatus according to claim 9, wherein a first sound-absorbing layer is provided at an inner wall of the noise reduction cavity; and/or, a second sound-absorbing layer is provided at a side, facing an interior of the noise reduction cabin, of at least one selected from the group consisting of the cabin top wall, the cabin side wall, and the cabin door.

12. The fracturing apparatus according to claim 9, wherein a distance between one end of the exhaust outlet close to the labyrinth noise reduction portion and the supporting surface of the platform is greater than a distance between one end of the exhaust outlet away from the labyrinth noise reduction portion and the supporting surface, so that the exhaust outlet exhausts obliquely upward away from the platform.

13. The fracturing apparatus according to claim 8, wherein the plurality of baffle plates are arranged in a direction perpendicular to the supporting surface of the platform, each of the plurality of baffle plates comprises at least two sub-portions connected in sequence to form a bending portion, and a gap is provided between adjacent baffle plates.

14. The fracturing apparatus according to claim 3, wherein at least one of the cabin side wall and the cabin door is provided with the air inlet.

15. The fracturing apparatus according to claim 3, further comprising:

an electric control cabinet, located in the noise reduction cabin; and a lubricating motor, located in the noise reduction cabin, wherein the electric control cabinet comprises a frequency converter, the main motor is located between the electric control cabinet and the plunger pump, and the main motor is located between the lubricating motor and the plunger pump.

16. The fracturing apparatus according to claim 15, wherein the electric control cabinet is located between the first radiator and the platform, and an orthographic projection of the electric control cabinet on the supporting surface overlaps with an orthographic projection of the first radiator on the supporting surface.

17. The fracturing apparatus according to claim 15, wherein the lubricating motor is located between the first radiator and the platform, and an orthographic projection of the lubricating motor on the supporting surface overlaps with an orthographic projection of the first radiator on the supporting surface.

18. The fracturing apparatus according to claim 15, wherein the cabin door comprises a first cabin door and a second cabin door, the first cabin door is configured to expose the electric control cabinet, and the second cabin door is configured to expose the lubricating motor;

when the first and second cabin doors are closed, the second cabin door overlaps with the first cabin door, and an overlapping part of the second cabin door is located at an outer side of an overlapping part of the first cabin door.

19. The fracturing apparatus according to claim 9, wherein the exhaust outlet is provided with a cover plate, and a flow guide groove is provided at a side of the noise reduction cavity close to the platform.

20. The fracturing apparatus according to claim 9, wherein a hook is provided at a surface of the noise reduction structure away from the main motor, and an orthographic projection of the hook overlaps with the orthographic projection of the portion of the transmission shaft on the supporting surface of the platform.

* * * * *